US005112391A

United States Patent [19]

Owen et al.

[11] Patent Number: 5,112,391

[45] Date of Patent: May 12, 1992

[54] METHOD OF FORMING ORE PELLETS WITH SUPERABSORBENT POLYMER

[75] Inventors: David O. Owen, Aurora; Jacqueline J. Bonin, Oak Park, both of Ill.

[73] Assignee: Nalco Chemical Company, Naperville, Ill.

[21] Appl. No.: 502,383

[22] Filed: Mar. 30, 1990

[51] Int. Cl.[5] ..... C22B 1/244

[52] U.S. Cl. ..... 75/772; 75/313; 75/321

[58] Field of Search ..... 75/313, 321, 772

[56] References Cited

U.S. PATENT DOCUMENTS

| | | | |
|---|---|---|---|
| Re. 28,474 | 7/1974 | Anderson et al. . | |
| 2,578,919 | 8/1956 | De Vaney et al. . | |
| 2,596,132 | 9/1956 | De Vaney . | |
| 2,771,355 | 11/1956 | Cohen . | |
| 2,914,394 | 11/1959 | Dohmen . | |
| 3,154,403 | 10/1964 | Stickley et al. . | |
| 3,180,723 | 4/1965 | McCauley . | |
| 3,377,146 | 4/1968 | Vonstroh . | |
| 3,893,847 | 7/1975 | Percy . | |
| 4,295,987 | 10/1981 | Parks . | |
| 4,654,039 | 3/1987 | Brandt et al. . | |
| 4,684,549 | 8/1987 | Allen et al. | 75/767 |
| 4,690,971 | 9/1987 | Flescher et al. | 210/751 |
| 4,751,259 | 6/1988 | Roe et al. . | |
| 4,767,449 | 8/1988 | Rosen et al. | 75/321 |
| 4,836,940 | 6/1989 | Alexander | 175/72 |

FOREIGN PATENT DOCUMENTS

| | | |
|---|---|---|
| 225171 | 10/1987 | European Pat. Off. . |

*Primary Examiner*—Melvyn J. Andrews

*Attorney, Agent, or Firm*—Robert A. Miller; Donald G. Epple

[57] ABSTRACT

A binder composition and method for its use to bind metal ores in a pelletizing process is disclosed. The composition includes the use of superabsorbent cross-linked polymers alone or in combination with at least one of the materials chosen from linear water-soluble vinyl addition polymers and polysaccharides.

3 Claims, No Drawings

METHOD OF FORMING ORE PELLETS WITH SUPERABSORBENT POLYMER

INTRODUCTION

The use of various binding agents in the process of pelletizing metal ores, particularly iron ores or taconite, are known, see for example, U.S. Pat. No. 3,377,146, and U.S. Pat. No. 3,893,847, both of which patents are incorporated herein by reference. Commonly, these binding agents are used at concentrations ranging from about 0.1 to about 5.0 weight percent of the total crushed ore being pelletized. However, because of the cost of these binding agents, it is preferable to be able to have a binding agent and a technology available for use of those binding agents which can minimize the amount of binding agent used to obtain both the green pellets and the dry pellets recoverable in this process.

The metal-containing ores which are pelletized in accordance to this invention may be almost any type of metallic mineral ore. Predominant ores are represented by those ores containing Pb, Cu, Ni, Zn, U, Fe, and the like. Particularly effective results can be realised in the practise of our invention in the pelletizing of minerals containing iron ores. These minerals, sometimes referred to as taconites, may contain iron ore deposits coming directly from the mining sites, such as taconites, or they may also be recoverable from ore tailings, flue dust, cold and hot fines from a sinter process, or iron ore which is found in sludge recoverable from various processes, e.g. steel mills, or from natural sources such as mining operations and the like. Any sources of these metal ores and their concentrates, particularly the iron ores or combinations thereof may be employed according to their availability and particular process set-up in the pelletizing unit.

Iron ore, or taconite ores, or any of a wide variety of minerals may form a part of the material to be pelletized. These other minerals can include, but are not limited to include magnetite, hematite, limonite, goethite, siderite, franklinite, ilmenite, chromite, pyrite, and the like. Our invention is particularly useful in pelletizing taconite and other iron-containing crushed ores.

PRIOR PRACTISES

Prior practises have included the use of polysaccharides such as naturally occurring starches, either by themselves or in combination with water-soluble vinyl addition polymers such as polyacrylic acid or its salts. When these water-soluble vinyl addition polymers have been used, they have been used either as a dry polymer or a polymer in water solution, or they have also been used and taught as contained in a water-in-oil emulsion of the water-soluble vinyl addition polymer which emulsion contains at least ten percent by weight of the water-soluble vinyl addition polymer, for example, U.S. Pat. No. 4,751,259, which is incorporated herein by reference.

The problems with using such materials, particularly in combination, is that either the green strength or the dry strength suffers and the drum control using the material is difficult, particularly if the emphasis is required that a minimum amount of binding agent is used for economic purposes.

Our invention, on the other hand, provides for the use of materials which can be handled easily, either in combination with one another, or added incrementally in any order, and which materials include some of the materials of the prior art, but also include, importantly, a superabsorbent polymer obtained from cross-linked polyacrylate absorbents.

THE SUPERABSORBENT POLYMERS

These cross-linked polyacrylate absorbents are described, for example, in U.S. Pat. No. 4,295,987 and U.S. Pat. No. 4,654,939, both of which are incorporated herein by reference. These superabsorbent polymers are capable of forming hydro-gels and also capable of absorbing a very large percentage of their weight in water. The preferred superabsorbent polymers of our invention are the so-called superabsorbent fines which are very small particle sized hydro-gel materials normally recovered from a superabsorbent manufacturing process, but which have such small particle size that they cannot be properly used, for example, in water absorption processes, for example, in baby diapers and the like.

These superabsorbent polymers are manufactured primarily from olefinically unsaturated carboxylic acid and/or carboxylic acid anhydride monomers, including acrylic acid, methacrylic acid, ethacrylic acid, crotonic acid, and the like. Other monomers might be also used in the manufacture of these superabsorbent hydro-gel polymers. See, for example, U.S. Pat. No. 4,654,039 and the extensive lists of monomers which are useful to make superabsorbent polymers as described therein.

A second essential element in the formation of these superabsorbent hydro-gel forming superabsorbent polymers is a cross-linking agent, which cross-linking agent is preferably divinylic in nature, and is incorporated into the superabsorbent polymer in a way to assist in gel volume, gel strength, extractable polymer content, and superabsorbent characteristics, such as rate and amount of water absorbed per unit time periods. Such suitable cross-linking agents include compounds having at least two polymerizable double bonds, compounds having at least one polymerizable double bond and at least one functional group reactive with the acid-containing monomer material, compounds having at least two functional groups reactive with the acid-containing monomer material, or polyvalent metal compounds which can form ionic cross-linkages. Preferred cross-linking agents having at least two polymerizable double bonds include di- or polyvinyl compounds such as divinylbenzene or divinyltoluene, di- or polyesters of unsaturated mono- or polycarboxylic acids with polyols, bisacrylamides, for example N,N-methylene bis acrylamide, di- or polyallyl ethers of polyols, di- or polyallyl esters of carboxylic acids, di- or triallyl amines, and the like.

Our binding agent includes these superabsorbent polymers, used alone or preferably in combination with at least one of the further ingredients chosen from the group consisting of water-soluble vinyl addition polymers, and polysaccharides.

THE VINYL POLYMERS

The water-soluble vinyl addition polymers are those polymers formed preferably by polymerizing monomers such as acrylic acid, methacrylic acid, acrylamide, methacrylamide, 2-acrylamido-2-methylpropanesulfonic acid (hereafter AMPS), and the like. Preferably, these water-soluble vinyl addition polymers have molecular weights (weight average molecular weight) of at least 500,000, preferably at least 1,000,000, and most preferably at least about 2,000,000. These water-soluble vinyl addition polymers may be used as powdered materials or may be used as water gels, or may be used in the form of an water-in-oil emulsion which contains at least ten percent by weight of the water-soluble vinyl addition polymer.

The preferred water-soluble vinyl addition polymers are chosen from the group consisting of homopolymers of acylic acid, copolymers of acrylic acid with at least one of the monomers acrylamide and AMPS, or homopolymers of acrylamide and copolymers of acrylamide with at least one of the monomers acrylic acid and AMPS.

The most preferred water-soluble vinyl addition polymer useful in our invention is a water-soluble vinyl addition polymer obtained in water-in-oil latex form, which polymer is manufactured from at least one of the monomers chosen from the group consisting of acrylic acid, acrylamide, and AMPS. When the polymers are used in a water-in-oil emulsion, the water-in-oil emulsion contains the following components and weight percentages:

(a) water-soluble vinyl addition polymer
(1) generally from 10–60 percent,
(2) preferably from 20–40 percent, and
(3) most preferably from 25–35 percent;
(b) water
(1) generally from 20–80 percent,
(2) preferably from 20–70 percent,
(3) most preferably from 30–55 percent;
(c) hydrophobic liquid (oils)
(1) generally from 5–75 percent,
(2) preferably from 5–40 percent,
(3) most preferably from 20–30 percent;
(d) water-in-oil emulsifying agents
(1) generally from 0.1–20 percent,
(2) preferably from 1–15 percent,
(3) most preferably from 1.2–10 percent.

For a generalised description of these types of water-soluble vinyl addition polymers, particularly relating to those polymers in water-in-oil latex form, please see U.S. Pat. No. RE 28,576, the disclosure of which is incorporated herein by reference.

The binding agents of our invention include the superabsorbent polymers and the water-soluble vinyl addition polymers described above that are preferably combined with a polysaccharide, which polysaccharide is normally chosen from the group consisting of starches, dextrins, modified starches, modified dextrins, and the like.

THE POLYSACCHARIDES

The term "polysaccharides" as used herein include starches, modified starches, cellulose, modified cellulose, sugars, and gums. The polysaccharides are disaccharides, trisaccharides, and above. Preferred polysaccharides are tetra-, penta-, and higher polysaccharides, and oligosaccharides containing at least four linked monosaccharide molecules and derivatives thereof. The preferred polysaccharides of this invention include starch and water-soluble derivatives of starch, such as chlorohydroxypropyl starch, phenylhydroxyethyl starch, hydroxybutyl starch, methyl starch, ethyl starch, hydroxyethyl starch, hydroxyethylmethyl starch, and the like. Amylose and amylopectin, or naturally or synthesized admixtures thereof are useful in the invention.

The preferred polysaccharides are corn starch, potato starch, dextrins, pre-gelatinized starches, ethoxylated starches, carboxymethyl cellulose, or combinations thereof. The most preferred polysaccharide is a pre-gelatinized corn starch. When we refer to starch, however, we mean any starch, such as corn starch, potato starch, or any processed or chemically modified starch, such as hydroxyethyl starch, hydroxypropyl starch, phosphorylated starches, and the like.

BINDING AGENTS

When our binding agents are used to pelletize metal ores, particularly iron ores, the ingredients above are added to the crushed ore, either simultaneously or incrementally, in such a way as to provide for an effective binding amount of superabsorbent binding agent, which binding agent is admixed with crushed ores so as to obtain a binding agent/ore mixture. This binding agent-/ore mixture normally contains sufficient water to be wetted, and is pelletized and dried in a way to provide a pelleted metal-containing ore pellet.

We have invented a method of pelletizing crushed metal-containing ores which comprises adding to said crushed ores an effective binding amount of superabsorbent polymer binding agents, then admixing said superabsorbent polymer binding agents with said crushed ores to form a binding agent/ore mixture and then pelletizing and drying said admixture to form a pelleted metal-containing ore.

Our invention is particularly useful when the superabsorbent polymer binding agent contains a superabsorbent polymer either alone or preferably in combination with at least one of the ingredients chosen from the group consisting of a water-soluble vinyl addition polymer and a naturally occurring polysaccharide.

Our method of pelletizing crushed metal-containing ores is particularly useful when the binding agent formulation is chosen from the group consisting of (a) blends of superabsorbent polymer and water-soluble vinyl addition polymer,
(b) blends of superabsorbent polymer and naturally occurring polysaccharide,
(c) blends of superabsorbent polymer and both water-soluble vinyl addition polymer and naturally occurring polysaccharides and modified polysaccharides.

We have invented a method of forming pelleted ores from wet crushed ore, which comprises adding to a solid crushed raw ore an effective wetting amount of water (this amount of water may be naturally contained in the crushed ore) and an effective binding amount of an ore-binding agent, thereby forming a binding agent/-crushed ore wet blend, then admixing said wet blend to thoroughly distribute said binding agent within the wet blend, and then forming discrete so-called green pellets from said wet blend, and thereafter drying said green pellets to form a pelleted metal ore. Our method further comprises the use as an ore-binding agent of superabsorbent polymers, as described above, either alone or in a blend with at least one other component chosen from the group consisting of linear water-soluble vinyl addition polymers containing at least one of the monomers chosen from the group acrylic acid, methacrylic acid, acrylamide, methacrylamide, and 2-acrylamido-2-methylpropanesulfonic acid, and which polymers have a weight average molecular weight of at least 500,000, and a polysaccharide, and mixtures thereof.

It is preferred that the superabsorbent polymer is a cross-linked polymer containing acrylic acid monomer cross-linked with at least one divinylic cross-linking agent chosen from the group consisting of divinylbenzene, divinyltoluene, N,N-methylenebisacrylamide, di- or polyallyl esters of polycarboxylic acids, diallylamine, triallylamine, and mixtures thereof.

The preferred acrylic acid based superabsorbent polymer is preferably neutralized with alkali metal hydroxides, ammonium, or amines, and may be neutralized from about one mole percent of the total carboxylic acids present, up to and including one hundred mole percent of the total carboxylic acid functionality present in the cross-linked superabsorbent polymer.

It is also most preferable that the superabsorbent polymer used in the invention be a so-called superabsorbent fines product. These fines products are those materials which are of such low particle size that they are not normally useful in normal types of applications of the superabsorbent gel polymers. The particle size of superabsorbent fines is normally below about eighty microns in diameter and may be as low as 50 microns or below. The superabsorbent polymer normally has a molecular weight of at least 1,000,000, preferably has a molecular weight of at least 5,000,000, and can have a molecular weight of at least 7,000,000, and above.

The linear water-soluble vinyl addition polymers which are combined with the superabsorbent polymers are preferably copolymers containing acrylamide with at least one other monomer chosen from the group consisting of acrylic acid, and 2-acrylamido-2-methylpropanesulfonic acid. Also, these polymers may be preferably those copolymers containing acrylic acid with at least one other monomer chosen from the group consisting of acrylamide and 2-acrylamido-2-methylpropanesulfonic acid.

The polysaccharides are preferably pre-gelatinized corn starches.

In using the combination products, each product may be separately added to the crushed ore prior to blending the crushed ore with the binding agents. However, it is not critical that each product be separately added to the crushed ore prior to blending. A combination product may be used which contains the superabsorbent polymer with at least one of the linear water-soluble vinyl addition polymers, and the polysaccharide.

When using the preferred binding agents, they are used in ratios ranging from about 0.1 to 1 to 10, superabsorbent polymer, linear water-soluble vinyl addition polymer, and polysaccharide to 10 to 1 to 0.1 of superabsorbent polymer, water-soluble vinyl addition polymer, and polysaccharide to a ratio of 0.1 to 10 to 0.1 superabsorbent polymer, linear polymer and polysaccharide. Most preferably, these new binding agents can contain superabsorbent polymer, preferably as superabsorbent polymer fines in from about 1 to about 99 weight percent in combination with from 0 to 90 weight percent of the linear water-soluble vinyl addition polymer and from 0 to 90 weight percent of the polysaccharide starch.

Preferably, the binding agents comprise from 10 to about 75 weight percent superabsorbent polymer fines, from about 0 to about 75 weight percent linear water-soluble vinyl addition polymer, and from about 0–85 weight percent starch.

Other materials may also be present in the binding agents. For example, when the linear water-soluble vinyl addition polymer is a water-in-oil latex, the oil, water, and surfactants present in this latex material will also be present in the binding agent, in proportionate amounts. It is most preferable that our formulation contain from about 12–75 weight percent superabsorbent polymer fines, from about 5 to about 70 weight percent linear water-soluble vinyl addition polymer, and from about 5–80 weight percent starch.

Our binding agents are used in dosages ranging from about zero to four pounds per LT of polymer, from 0–6 pounds per LT of starch, and from 0.1–2 pounds per LT of superabsorbent polymer. (LT means long ton of ore, or about 2200 pounds of crushed ore.) By altering the ratio of the components, the minimum amount of total organic binder can be applied to achieve both the physical parameters of the pellet as well as proper drum control under changing pelletizing drum-feed characteristics. The ore being pelleted characteristically changes in terms of moisture content, particle size, organic contaminants, and the like. Because of these changes, it is beneficial to have the superabsorbent polymers or the tertiary combinations or the binary combinations thereof, as described above, fed to the crushed ore in such a way as to control rate of feed and ratios of binding ingredients allowing the plant operator to minimize the amount of total organic binding agent while simultaneously maintaining drum control, moisture content, particle size, ore composition, and pellet strength, and physical characteristics of both the green pellets and final dried pellets. Combination of one or more of the binding agent components into a single mixture is possible, prior to addition to the crushed ore, but preferably if this combination is made, the operations should include good control to provide consistent ore characteristics to the blending operation prior to pelletizing.

Also, in addition to the organic binders of our invention as described above, inorganic binders can also be used in combination therewith. Such inorganic binders can include various types of clays, or inorganic salts, such as lime, sodium sulfate, sodium carbonate, bentonite clay, and the like. A particularly preferable inorganic binder is bentonite clay.

EXAMPLES

To further exemplify our invention, we provide the following Tables.

TABLE 1

THE EFFECT OF MOISTURE ON GREEN DROP STRENGTH AND DRY COMPRESSION STRENGTH

| Product Domestic Ore 1 | Dosage (lb/LT) | Percent Moisture | Green Drop 17") | Dry Compression Strength (lb) |
|---|---|---|---|---|
| Bentonite + Polymer A | 10 + 1 | 9.30 | 9.2 ± 2.6 | 7.9 ± 1.8 |
| | | 10.1 | 15.2 ± 3.5 | 7.2 ± 1.2 |
| | | 10.8 | 22.8 ± 4.0 | 8.2 ± 1.7 |

TABLE II

THE EFFECT OF PRODUCT A ON GREEN STRENGTH

| Product | Dosage (lb/LT) | Percent Moisture | Green Drop 17") | Dry Compression Strength (lb) |
|---|---|---|---|---|
| Domestic Acid Ore 1 | | | | |
| Bentonite + Product C + Product A | 15 + 0.68 + 0.0 | 9.8 | 4.4 | 7.1 |

TABLE II-continued

THE EFFECT OF PRODUCT A ON GREEN STRENGTH

| Product | Dosage (lb/LT) | Percent Moisture | Green Drop 17") | Dry Compression Strength (lb) |
|---|---|---|---|---|
| Bentonite + Product C + Product A | 15 + 0.68 + 0.32 | 10.1 | 6.9 | 7.3 |
| Bentonite + Product C + Product A | 15 + 0.68 + 0.64 | 10.3 | 9.1 | 7.4 |
| Bentonite + Product C + Product A | 15 + 0.68 + 0.96 | 10.2 | 11.0 | 8.0 |
| Domestic Fluxed Ore 2 | | | | |
| Bentonite + Product C + Product A | 10 + 0.74 + 0.5 | 9.7 | 5.3 ± 0.83 | 7.3 ± 0.8 |
| Bentonite + Product C + Product A | 10 + 0.74 + 1.0 | 9.9 | 9.8 ± 2.1 | 7.9 ± 0.9 |
| Bentonite + Prod. C + Prod. E + Prod. A | 9 + 1.4 + 0.1 + 0.25 | 10.7 | 14.2 ± 5.1 | 8.7 ± 1.6 |
| Bentonite + Prod. C + Prod. E + Prod. A | 9 + 1.4 + 0.1 + 0.5 | 10.7 | 26.0 ± 4.4 | 8.9 ± 1.3 |
| Domestic Fluxed Ore 2 | | | | |
| Bentonite + Product D + Product A | 9 + 0.82 + 0.25 | 10.4 | 8.6 ± 1.5 | 7.0 ± 0.9 |
| Bentonite + Product D + Product A | 9 + 0.82 + 0.5 | 10.5 | 14.2 ± 4.5 | 7.1 ± 0.8 |
| Bentonite + Product D + Product A | 9 + 0.82 + 1.0 | 10.5 | 28.8 ± 6.2 | 7.8 ± 1.0 |
| Domestic Acid Ore 3 | | | | |
| Bentonite + Product A | 10 + 1.0 | 9.5 | 8.7 ± 1.3 | 7.96 ± 0.82 |
| Bentonite + Product A | 10 + 2.0 | 9.9 | 18.4 ± 3.8 | 9.86 ± 1.21 |
| Bentonite + Product A | 10 + 3.0 | 9.7 | 21.5 ± 4.5 | 10.57 ± 1.14 |
| European Fluxed Ore 1 | | | | |
| Bentonite + Product A | 10 + 1 | 8.2 | 3.9 ± 0.7 | 6.9 ± 0.7 |
| Bentonite + Product A | 10 + 2 | 8.5 | 5.5 ± 0.9 | 8.1 ± 1.1 |
| Bentonite + Product A | 10 + 3 | 9.7 | 8.7 ± 1.7 | 7.9 ± 0.8 |

TABLE III

THE EFFECT OF DRY ADDITIVES ON DRY COMPRESSION STRENGTH

| Product | Dosage (lb/LT) | Percent Moisture | Green Drop 17") | Dry Compression Strength (lb) |
|---|---|---|---|---|
| Domestic Acid Ore 1 | | | | |
| Bentonite + Product C + Product A | 15 + 0.00 + 0.32 | 10.2 | 6.0 | 6.4 |
| Bentonite + Product C + Product A | 15 + 0.68 + 0.32 | 10.1 | 6.9 | 7.3 |
| Bentonite + Product C + Product A | 15 + 0.93 + 0.32 | 10.1 | 6.2 | 8.3 |
| Bentonite + Product C + Product A | 15 + 1.36 + 0.32 | 9.9 | 6.2 | 8.5 |
| Domestic Fluxed Ore 2 | | | | |
| Bentonite + Product B + Product A | 10 + 0.5 + 1.0 | 10.0 | 25.0 ± 3.3 | 15.8 ± 1.8 |
| Bentonite + Product B + Product A | 10 + 1.0 + 1.0 | 10.2 | 29.7 ± 3.8 | 17.8 ± 2.6 |
| Domestic Fluxed Ore 2 | | | | |
| Bentonite + Product C + Product A | 9 + 0.74 + 0.5 | 9.7 | 5.3 ± 0.83 | 7.3 ± 0.9 |
| Bentonite + Product C + Product A | 9 + 1.4 + 0.5 | 9.8 | 5.4 ± 0.53 | 8.9 ± 1.3 |
| Domestic Fluxed Ore 2 | | | | |
| Bentonite + Prod. C + Prod. E + Prod. A | 9 + 0.74 + 0.1 + 0.5 | 10.6 | 26.3 ± 7.0 | 8.0 ± 1.5 |
| Bentonite + Prod. C + Prod. E + Prod. A | 9 + 1.4 + 0.1 + 0.5 | 10.7 | 26.0 ± 4.4 | 8.9 ± 1.3 |
| Domestic Acid Ore 3 | | | | |
| Bentonite + Product B + Product A | 10 + 1 + 1 | 9.0 | 7.4 ± 0.9 | 11.1 ± 1.4 |
| Bentonite + Product B + Product A | 10 + 2 + 1 | 9.0 | 9.1 ± 1.2 | 12.4 ± 1.9 |
| Bentonite + Product B + Product A | 10 + 3 + 1 | 9.4 | 8.6 ± 1.5 | 14.9 ± 2.3 |
| European Fluxed Ore 1 | | | | |
| Bentonite + Product C + Product A | 8 ± 0.25 + 1.0 | 8.0 | 3.7 | 7.0 |
| Bentonite + Product C + Product A | 8 ± 0.5 + 1.0 | 8.0 | 4.1 | 8.1 |

TABLE IV

THE EFFECT OF PRODUCT E ON DRY COMPRESSION STRENGTH

| Product | Dosage (lb/LT) | Percent Moisture | Green Drop 17") | Dry Compression Strength (lb) |
|---|---|---|---|---|
| Domestic Acid Ore 1 | | | | |
| Bentonite + Prod. C + Prod. E + Prod. A | 15 + 0.68 + 0.0 + 0.32 | 11.8 | 12.2 | 7.4 |
| Bentonite + Prod. C + Prod. E + Prod. A | 15 + 0.68 + 0.1 + 0.32 | 11.9 | 11.0 | 8.7 |
| Bentonite + Prod. C + Prod. E + Prod. A | 15 + 0.68 + 0.2 + 0.32 | 11.3 | 17.6 | 8.7 |
| Domestic Fluxed Ore 2 | | | | |
| Bentonite + Prod. C + Prod. E + Prod. A | 9 + 1.4 + 0.0 + 0.5 | 10.4 | 21.0 ± 3.7 | 8.3 ± 0.9 |
| Bentonite + Prod. C + Prod. E + Prod. A | 9 + 1.4 + 0.05 + 0.5 | 10.5 | 20.5 ± 4.2 | 8.7 ± 1.4 |
| Bentonite + Prod. C + Prod. E + Prod. A | 9 + 1.4 + 0.1 + 0.5 | 10.7 | 26.0 ± 4.4 | 8.9 ± 1.3 |
| Bentonite + Prod. C + Prod. E + Prod. A | 9 + 1.4 + 0.2 + 0.5 | 10.6 | 21.0 ± 4.5 | 9.1 ± 1.5 |

TABLE V

THE EFFECT OF PRODUCT E ON SIZE RANGE $-\frac{1}{2} + \frac{3}{8}$M)

| Product Domestic Fluxed Ore 2 | Dosage (lb/LT) | Percent of Pellets ($-\frac{1}{2} + \frac{3}{8}$M) | Percent Moisture |
|---|---|---|---|
| Bentonite + Prod. C + Prod. E + Prod. A | 9 + 1.4 + 0.0 + 0.5 | 8.5 | 10.4 |
| Bentonite + Prod. C + Prod. E + Prod. A | 9 + 1.4 + 0.05 + 0.5 | 10.2 | 10.5 |

TABLE V-continued

THE EFFECT OF PRODUCT E ON SIZE RANGE $-\frac{1}{2}+\frac{3}{8}$M)

| Product Domestic Fluxed Ore 2 | Dosage (lb/LT) | Percent of Pellets ($-\frac{1}{2}+\frac{3}{8}$M) | Percent Moisture |
|---|---|---|---|
| Bentonite + Prod. C + Prod. E + Prod. A | 9 + 1.4 + 0.1 + 0.5 | 15.1 | 10.7 |
| Bentonite + Prod. C + Prod. E + Prod. A | 9 + 1.4 + 0.2 + 0.5 | 16.2 | 10.6 |

TABLE VI

DRUM CONTROL AND PELLET QUALITY AS A FUNCTION OF PRODUCT E (SUPERABSORBENT POLYMER) ON DOMESTIC ACID ORE 1

| Product E (lb/ton) | Drum Control (0 = worst; 3 = best) | Pellet Quality |
|---|---|---|
| 0.0 | 2.0 | sticky, wet, riders |
| 0.09 | 1.5 | wet, riders |
| 0.14 | 1.0 | fair |
| 0.19 | 2.0 | good |
| 0.24 | 3.0 | good |
| 0.29 | 1.0 | somewhat dry |
| 0.34 | 1.0 | dry |
| 0.44 | 0.0 | very dry |

TABLE VII

COMBINATIONS OF POLYMER, STARCH, AND/OR SUPERABSORBENT

| Product Combination | Dosage | Ore | Notebook | Green Strength | Dry Compression |
|---|---|---|---|---|---|
| Bentonite + Prod. A + Prod. C + Prod. E | 9 + 0.5 + 1.4 + 0.2 | Domestic Fluxed Ore 2 | 2736-278 | 21.0 ± 4.5 | 9.1 ± 1.5 |
| Bentonite + Product A + Product C | 9 + 0.5 + 1.4 | Domestic Fluxed Ore 2 | 2736-278 | 21.0 ± 3.7 | 8.3 ± 0.9 |
| Bentonite + Product A + Product E | 9 + 0.5 + 0.1 | Domestic Fluxed Ore 2 | 2736-279 | 15.8 ± 4.1 | 6.1 ± 0.8 |
| Bentonite + Product C + Product E | 8 + 0.9 + 0.1 | Domestic Acid Ore 1 | 3088-25 | 4.8 ± 2.0 | 4.9 ± 0.6 |
| Bentonite + Product A | 10 + 1.0 | Domestic Acid Ore 1 | 2736-214 | 15.2 ± 3.5 | 7.2 ± 1.2 |
| Bentonite + Product C | 8 + 0.8 | European Fluxed Ore 4 | 2736-295 | 3.1 | 7.6 |
| Bentonite + Product E | 8 + 0.5 | Domestic Acid Ore 1 | 3088-27 | 3.3 ± 0.8 | 2.9 ± 0.5 |
| Bentonite + Product F + Product D | 8 + 0.2 + 0.8 | Domestic Acid Ore 1 | 3088-27 | 5.1 ± 1.0 | 5.4 ± 1.0 |

TABLE VIII

| | |
|---|---|
| Product A | a copolymer of 11% (molar) AMPS/89% (molar) acrylamide 28% active polymer in water-in-oil emulsion, RSV = 17-23 molecular weight = 5-10 MM |
| Product B | 2-hydroxypropyl modified corn starch Hamaco 277; A.E. Staley Manufacturing Co. |
| Product C | 2-hydroxyethyl; 2-hydroxypropyl hydrogen phosphate, reacted corn starch Staramic 620; A.E. Staley Manufacturing Co. |
| Product D | 87.8 weight percent Product C 12.2 weight percent Superabsorbent polymer (Product E) |
| Product E | Superabsorbent polymer fines; cross-linked polyacrylate, partially neutralized (NaOH); particle size < 80 microns |
| Product F | homopolymer of acrylamide RSV - 16-24; molecular weight = 5-10 MM |

MM = one million

Table I shows green strength increasing as ore moisture increases. It also demonstrates that original moisture content of the ore has little effect on the dry strength as long as the composition and particle size of the ore remain relatively constant. Both observations have been made with a constant inorganic binder level (bentonite) and organic binder level.

Table II shows that the use of a latex polymer which contains acrylamide and AMPS monomer increases the green strength or green drop strength as the use of polymer increases. This effect of increasing green strength with the use of the latex polymer is observed irrespective of the type of ore into which the latex polymer is added. The term "acid ore" and "fluxed ore" refer to ore normally obtained and ores containing so-called fluxing agents such as lime, dolomite, mixtures thereof and the like. Latex polymer dosage also has a minimal, but positive, effect on dry strength.

Table III shows that as starch dosage is increased, dry strength increases. This effect is again seen irrespective of the type of ore (acid or fluxed) used and basically irrespective of varying levels of two different types of starches. Starch dosage had little or no effect on green strength. Comparisons of Table II and Table III, however, indicates that the amount of dry starch or latex necessary to achieve a given dry strength requires on average about one pound of latex for each pound increase in dry strength and only about 0.35-0.40 pounds of dry starch for an equivalent increase in dry strength.

Table IV shows that as the dosage of superabsorbent polymer is increased, the dry strength increases. Again, this effect is seen on both acid and flux ores. Superabsorbent polymer had no discernible effect on green strength.

Table V shows that as the superabsorbent polymer dosage is increased, ball-ability in laboratory bench tests is improved, as shown by the percentage of pellets generated in the correct size range using a particular fluxed ore.

Table VI shows that a plant balling drum control and pellet quality improved dramatically with dosage of superabsorbent on a particular acid ore. At low dosages, pellet quality is relatively poor, but at high dosages the drum cannot be controlled. Optimum dosage ranges, where both drum control and pellet quality are good, ranges between about 0.10 to about 0.25 pounds per LT (long ton or about 2200 pounds of ore treated). However, this optimal dosage level can be influenced by the moisture content in the ores.

Table VI demonstrates that the surface of the pellet is extremely important in the pelletizing process. If the surface is wet, finer particles stick to the surface and later come off, causing dusting and high pressures in the kiln. These finer stick-on particles are often referred to as riders. If the high pressure in the kiln becomes so great this can actually shut down the process. On the other hand, a pellet which is too dry prevents growth of the pellet, thus reducing pellet production, or leading to erratic pellet sizes. Altering dosage of the superabsorbent affects the moisture on the surface of the ore particles and, ultimately, the surface moisture itself. Thereby, an increase in superabsorbent polymer initially reduces surface moisture by an absorption process. However, if these materials are over-dosed, the superabsorbent polymer used will reduce the moisture of the surface to a point where the pellet will no longer agglomerate or pelletize. Therefore, the optimum ratio will vary from ore to ore depending upon surface moisture, particle size distributions, and superabsorbent characteristics.

Table VII shows that pellets can be made with the combinations of any of the products, polymer, starch, or superabsorbent. The polymer may be used as a water-in-oil latex, or may be used as a dry polymer, as demonstrated by the last example in this table.

Table VIII defines the polymers used and described in the earlier tables.

Having described our invention, we claim:

1. A method of forming metal ore pellets from wetted crushed ore comprising treating said ore with from 0.10 pounds per long ton of ore to about 5.0 pounds per long ton of ore of a binding agent comprising the ingredients: (a) superabsorbent polymer, (b) linear water-soluble vinyl addition polymer, (c) polysaccharide, wherein a:b:c is in the weight ratio of 10:0:1 to 10:1:10 to 10:10:1 to 1:10:10, admixing said binding agent and said ore to form an admixture, then pelletizing and drying said admixture to form said metal ore pellets.

2. The method of claim 1 wherein the ratio of a:b:c ranges from 10:0:1 to 1:10:10 to 1:0:10.

3. The method of claim 1 or 2 wherein the vinyl addition polymer has a weight average molecular weight of at least one million and is contained in a water-in-oil latex, and further wherein the polysaccharide is starch.

* * * * *

UNITED STATES PATENT AND TRADEMARK OFFICE

CERTIFICATE OF CORRECTION

PATENT NO. : 5,112,391

DATED : MAY 12, 1992

INVENTOR(S) : DAVID O. OWEN & JACQUELINE L. BONIN

It is certified that error appears in the above-identified patent and that said Letters Patent is hereby corrected as shown below:

On the title page, item (75):

INVENTORS: DAVID O. OWEN & JACQUELINE J. BONIN

SHOULD READ:

INVENTORS: DAVID O. OWEN & JACQUELINE L. BONIN

Signed and Sealed this

Seventeenth Day of August, 1993

Bruce Lehman

*Attest:*

BRUCE LEHMAN

*Attesting Officer*

*Commissioner of Patents and Trademarks*